United States Patent [19]

Hierholzer

[11] Patent Number: 4,516,591

[45] Date of Patent: May 14, 1985

[54] HIGHLIGHTING APPLICATOR

[76] Inventor: Melvin C. Hierholzer, 4213 Beard, Corpus Christi, Tex. 78413

[21] Appl. No.: 475,028

[22] Filed: Mar. 14, 1983

[51] Int. Cl.[3] ..... A45D 24/22; B43K 1/06

[52] U.S. Cl. ..... 132/88.7; 132/9; 132/116; 132/DIG. 4; 401/265

[58] Field of Search ..... 132/112, 113, 114, 115, 132/116, 88.5, 88.7, 161, DIG. 1, 7, 9, DIG. 4, 132/DIG. 3; D28/7, 20; 401/265

[56] References Cited

U.S. PATENT DOCUMENTS

| | | | |
|---|---|---|---|
| 924,048 | 6/1909 | Ensor | 132/116 |
| 1,051,715 | 1/1913 | Edwards | 132/116 |
| 1,190,017 | 7/1916 | Scheel | 132/116 |
| 1,876,033 | 9/1932 | Starr | 132/116 |
| 1,974,924 | 9/1934 | Macdonald | 132/161 |
| 2,139,709 | 12/1938 | Yaw | 132/161 |
| 2,397,321 | 3/1946 | Leach | 132/116 |
| 2,446,398 | 8/1948 | Wilson | 132/116 |
| 2,607,355 | 8/1952 | Neal | 132/116 |
| 2,755,807 | 7/1956 | Jorgensen | 132/116 |
| 2,956,570 | 10/1960 | Stanford | 132/116 |
| 3,446,216 | 5/1969 | Sala | 132/116 |
| 3,477,447 | 11/1969 | Eldredge | 132/9 |
| 3,570,499 | 3/1971 | Ruta | 132/9 |
| 3,952,755 | 4/1976 | Fisher | 132/161 |
| 4,310,009 | 1/1982 | Shipp | 132/88.5 |

FOREIGN PATENT DOCUMENTS

| | | | |
|---|---|---|---|
| 528984 | 3/1955 | Italy | 132/116 |

*Primary Examiner*—Richard J. Apley
*Assistant Examiner*—Carolyn A. Harrison
*Attorney, Agent, or Firm*—G. Turner Moller

[57] ABSTRACT

This applicator applies a hair treating material to the surface of less than all of an individual's hair. The applicator comprises a material supply container and a dispenser including a comb structure having a plurality of teeth pairs in which some of the pairs have shallow roots therebetween and some have deep roots. In a preferred embodiment of the invention, passages are provided in the dispensing comb structure to deliver the treating material through at least some of the shallow roots in order to apply the material to less than all of the hair of the individual.

18 Claims, 8 Drawing Figures

HIGHLIGHTING APPLICATOR

This invention relates to an applicator for dispensing a hair treating material to less than all of the hair of a recipient.

The application of bleach, dye or other hair treating material to an individual's hair is commonly done by professional hair stylists as well as by consumers. One of the commonly practiced techniques is to apply bleach or dye in streaks in the individual's hair to create a frosted or streaked appearance.

By the techniques presently used by professional stylists, streaking of hair is a time consuming, tedious operation which is consequently more expensive or less remunerative than might be imagined.

One of the techniques widely used in the industry to streak hair is to place a rubber cap on the head of the individual and use a crochet-hook like device to pull groups of strands through the perforations in the cap. After the desired amount of hair is pulled through the holes, the dye or bleach is applied to the exposed hair. The rubber cap keeps the hair underneath it from coming into contact with the dye or bleach thereby giving the desired frosted or streaked appearance. Not only is this technique tedious, the pulling of the selected strands of hair through the holes in the cap is somewhat painful.

One group of disclosures that are pertinent to this invention are found in U.S. Pat. Nos. 924,048; 1,051,715; 1,190,017; 1,876,033; 2,397,321; 2,607,355; 2,755,807 and 2,956,570. These disclosures broadly illustrate a material supply container in fluid communication with a comb like distributing structure in which fluid passages connect the material supply container to the gaps between less than all of the teeth. Applicant's original model looked very much like these devices but did not work to produce the desired effect of streaking the hair of the recipient. A study of these disclosures confirms applicant's results with his original model since none of these references purport to effect any differentiation in treatment between hair strands passing through comb teeth into material is injected and hair strands which pass between comb teeth into which no material is injected.

Analysis and observation of the operation of applicant's original model revealed that the failure to achieve a distinct streaking effect was the result of a combination of factors. First, the viscosity of conventionally available dyes and bleaches is so low that they tend to run or spread readily from an injected location between a pair of comb teeth to a location between the next pair of teeth. Second, applicant's original model did not separate those hair strands which were to be treated from those which were untreated.

A second group of disclosures which ae pertinent to this invention are found in U.S. Pat. Nos. 1,974,924; 2,139,709; and 3,952,755 which basically disclose combs in which the root depths between adjacent teeth are not uniform. Another reference of interest is U.S. Pat. No. 3,477,447.

In summary, the device of this invention comprises an applicator for treating less than all of the hair of an individual in order to achieve a frosted or streaked appearance. This is accomplished by injecting the hair treating material through a plurality of passages in a comb like dispenser. The dispenser provides a plurality of teeth roots which are of different depth. In the preferred embodiment of this invention, the passages open between those teeth that border a shallow root, i.e. those roots which are spaced nearest the free teeth ends. The dispenser includes means for attaching to a material supply container so that the hair treating material may pass between the container and the openings between the comb teeth.

When the comb like dispenser is drawn through the individual's hair, the shallow and deep roots act to divide the individual's hair into two groups of strands—those which will be treated and those which will not be treated. By maintaining tension on the ends of all the strands, the strands to be treated will be spaced from the strands not to be treated. In the preferred embodiment, the untreated strands are spaced upwardly from the treated strands so that the untreated strands may be gathered and temporarily bundled in order to allow the hair treating material to react or otherwise lose its potentcy.

It is accordingly an object of this invention to provide an improved technique for applying a hair treating material to less than all of the hair of an individual.

Another object of this invention is to provide an improved technique for streaking or frosting the hair of an individual.

A more specific object of this invention is to provide an applicator incorporating a comb like dispensing structure in which the teeth roots are of different depth.

Further objects and advantages of this invention will become more fully apparent as this description proceeds, reference being made to the accompanying drawings and appended claims.

IN THE DRAWINGS

Figure 1:
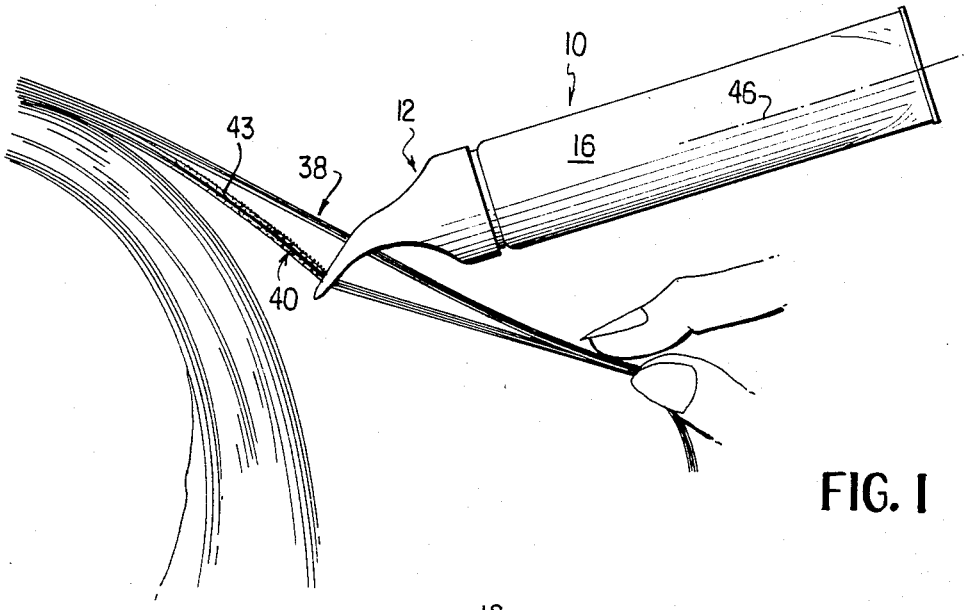
FIG. 1 is a pictorial view of the highlighting applicator of this invention in use.

Referring to FIGS. 1-4, there is illustrated a highlighting applicator 10 of this invention for applying a high treating material to less than all of the hair of an individual. The applicator 10 comprises a body 12 having a chamber 14 therein in communication with a material supply container 16 which is connected to the body 12 by suitable attaching means 18, such as cooperating threads.

The forward end of the highlighting application 10 comprises a comb structure 20 including a plurality of first teeth pairs 22 which comprise teeth 24, 26 which are spaced apart and connected, at the base thereof, by a shallow root 28. The comb structure 20 also comprises a plurality of second teeth pairs 30 which comprise teeth 32, 34 which are spaced apart and connected, at the base thereof, by a deep root 36.

Figure 2:
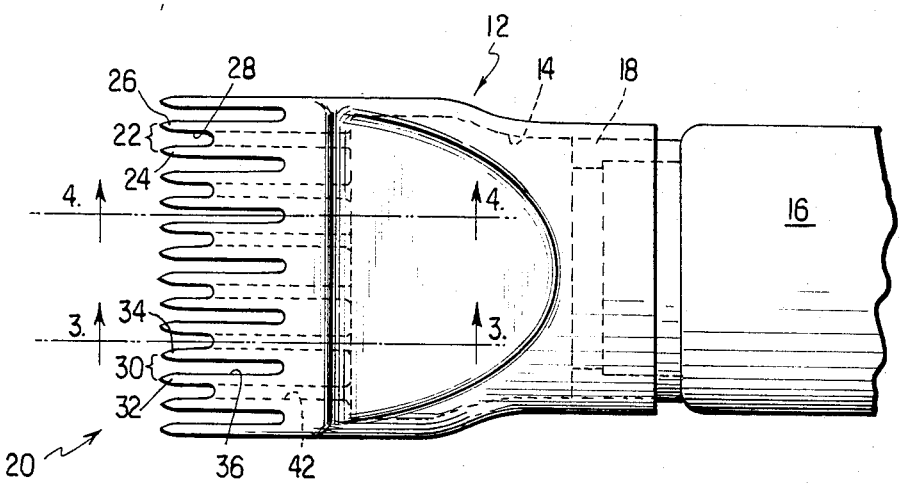
FIG. 2 is an enlarged top plan view of the highlighting applicator of FIG. 1.

In the particular configuration shown in FIG. 2, the teeth pairs 22, 30 share a common tooth. Likewise, the arrangement of the teeth is symmetrical.

More importantly, the depths of the roots 28, 36, by which is meant the distance from the free ends of the teeth to the base of the teeth, is different. Preferably, the distance between the roots 28, 36 is large enough to separate the hair of the individual into groups of strands 38, 40 which may be separately manipulated by the hair stylist. Desirably, the distance between the roots 28, 36, in the direction of the teeth, is uniform across the width of the comb structure 20.

Figure 3:
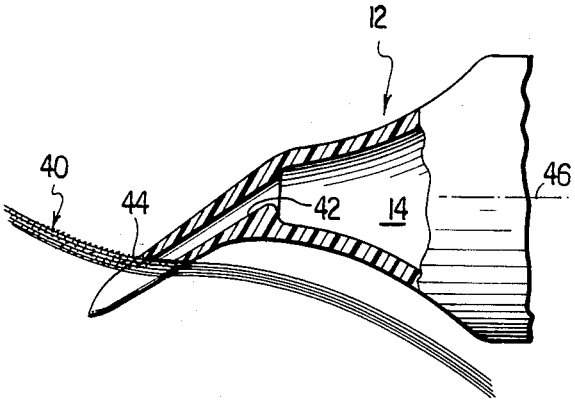
FIG. 3 is a longitudinal cross sectional view of the applicator of FIG. 2 taken substantially along line 3—3 thereof as viewed in the direction indicated by the arrows.
Figure 4:
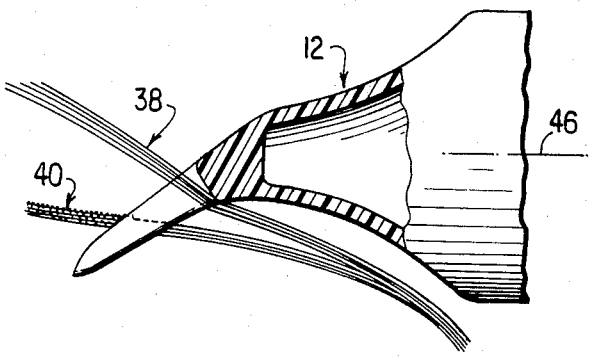
FIG. 4 is a longitudinal cross sectional view of the applicator of FIG. 2 taken substantially along line 4—4 thereof as viewed in the direction indicated by the arrows.

Conduit means 42 are provided in the comb structure 20 which communicate with the chamber 14 and open between the teeth 24, 26 of the first teeth pairs 22 and preferably open through the shallow roots 24 as shown best in FIGS. 2 and 3. Although each tooth pair 22 is illustrated as having a conduit 42 opening thereinto, it will be evident to those skilled in the art that different effects can be attained by varying the placement of the conduit means 42.

The mode of operation of the highlighting applicator 10 should now be apparent. The material supply container 16 is filled with a suitable hair treating material, such as bleach or dye, and coupled to the attaching means 18, as by threadably connecting the same. The individual's hair is prepared, in a customary manner, to receive the hair treating material, as by washing and partially or wholly drying the individual's hair.

The individual's hair is combed and a layer thereof is grasped by the stylist's fingers to maintain some tension on the hair. The applicator 10 is then combed through the individual's hair as shown in FIG. 1 with the container 16 being squeezed slightly to dispense the hair treating material into the chamber 14 and through the conduits 42 to exit onto those groups of strands 40 which reside between the teeth 24, 26 of the teeth pairs 22. Thus, a band 43 of the hair treating material is extruded onto the strands 40.

Because of the difference in spacing between the teeth roots 28, 36, the groups of strands 38, 40 are fairly widely separated during application so that the hair treating material applied to the strands 40 does not fall onto or mingle with the strands 38. Consequently, the hair treating material is applied in such a manner as to streak or highlight the individual's hair.

An important feature of this invention is illustrated in FIG. 3 where the surface 44 of the shallow root 28 is parallel to the direction of the strands 40 and generally parallel to the axis 46 of the material supply container 16. It will be appreciated that the movement of the applicator 10 along the strands 40 acts to wipe material exiting from the conduits 42 thereby preventing a buildup of material adjacent the roots 28.

Referring to FIGS. 5–8, there is illustrated another embodiment 50 of this invention for applying a hair treating material to less than all of the hair of an individual. The applicator 50 comprises a body 52 having a chamber 54 therein in communication with a material supply container 56 connected to the body 52 by suitable attaching means 58, such as cooperating threads.

The forward end of the highlighting applicator 50 comprises a comb structure 60 including a plurality of first teeth pairs 62 which comprise teeth 64, 66 which are spaced apart and connected, at the base thereof, by a deep root 68. The comb structure 60 also comprises a plurality of second teeth pairs 70 which comprise teeth 72, 74 which are spaced apart and connected, at the base thereof, by a shallow root 76.

Figure 6:
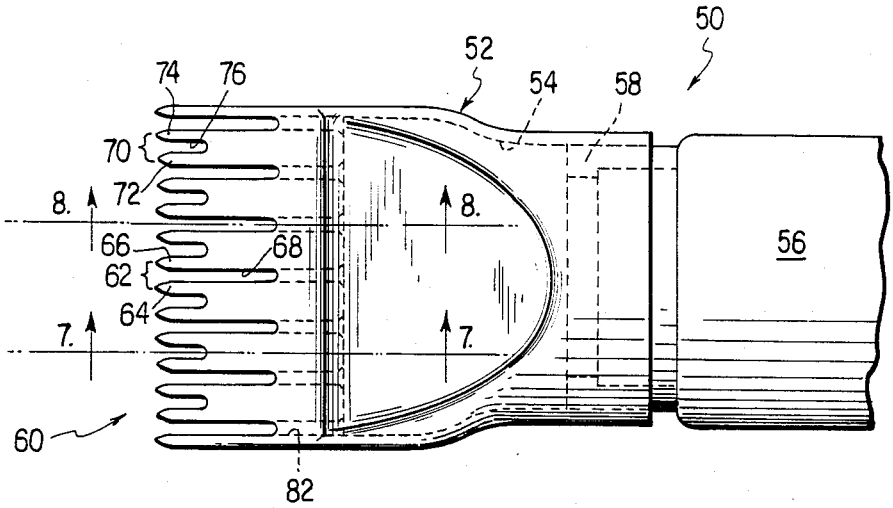
FIG. 6 is an enlarged top plan view of the applicator of FIG. 5.

In the particular configuration shown in FIG. 6, the teeth pairs 62, 70 share a common tooth. Likewise, the arrangement of teeth is symmetrical.

More importantly, the depths of the roots 68, 76 by which is meant the distance from the free ends of the teeth to the base of the teeth, is different. Preferably, the distance between the roots 68, 76 is large enough to separate the hair of the individual into groups of strands 78, 80 which may be separately manipulated by the hair stylist. Desirably, the distance between the roots 68, 76, in the direction of the teeth, is uniform across the width of the comb structure 60.

Figure 7:
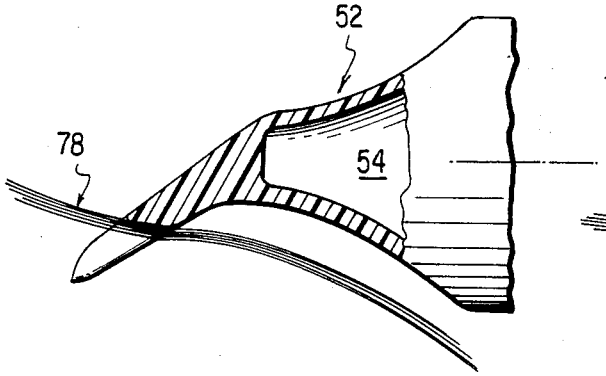
FIG. 7 is a longitudinal cross sectional view of the applicator of FIG. 6 taken substantially along line 7—7 thereof as viewed in the direction indicated by the arrows.
Figure 8:
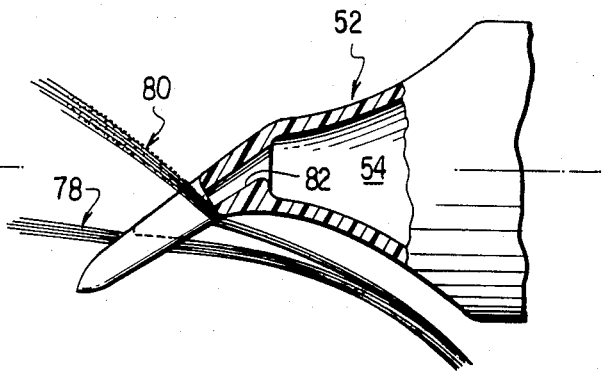
FIG. 8 is a longitudinal cross sectional view of the applicator of FIG. 6 taken substantially along line 8—8 thereof as viewed in the direction indicated by the arrows.

Conduit means 82 are provided in the comb structure 60 which communicates with the chamber 54 and open between the teeth 64, 66 of the first teeth pairs 62 and preferably open through the deep roots 64 as shown best in FIGS. 6 and 7. Although each tooth pair 62 is illustrated as having a conduit 82 opening thereinto, it will be evident to those skilled in the art that different effects can be obtained by varying the placement of the conduit means 82.

The mode of operation of the high lighting applicator 50 should now be apparent. The materials supply container 56 is filled with a suitable hair treating material, such as bleach or dye, and coupled to the attaching means 18, as by threadably connecting the same. The individual's hair is prepared, in a customary manner, to receive the hair treating material, as by washing and partially or wholly dying the individual's hair.

Figure 5:
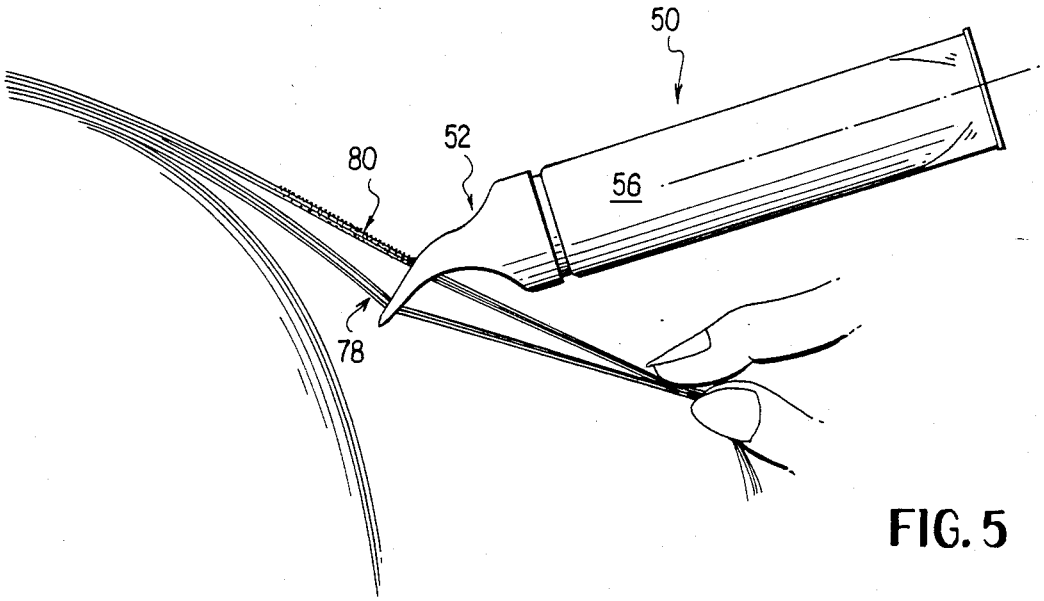
FIG. 5 is a pictorial view, similar to FIG. 1, showing another embodiment of this invention in use.

The individual's hair is combed and a layer thereof is grasped by the stylist's fingers to maintain some tension on the hair. The applicator 50 is then combed through the individual's hair as shown in FIG. 5 with the container 56 being squeezed slightly to dispense the hair treating material into the chamber 54 and through the conduits 82 to exit onto those groups of strands 80 which reside between the teeth 64, 66 of the teeth pairs 62.

Because of the difference in spacing between the teeth roots 68, 76, the groups of strands 78, 80 are fairly widely separated during application so that the hair treating material applied to the strands 80 does not mingle with the strands 78. Consequently, the hair treating material is applied in such a manner as to streak or highlight the individual's hair.

It will be appreciated that the devices 10, 50 of this invention act to separate the hair of an individual into groups of strands, some of which are treated and some of which are not. It will be appreciated that the strands are separated at the time the hair treating material is applied thereto and for some length of time thereafter. It the untreated strands 38, 78 can be gathered together and maintained separate from the treated strands 40, 80 at about the position shown in FIGS. 1 and 5, there will manifestly be very little bleeding of the hair treating material onto the strands 38, 78. It will be appreciated that the stylist's hands are both busy during the application of this material and an assistant is likely needed to gather the untreated strands from the treated strands.

Unless the untreated strands are gathered together as mentioned above, or otherwise wholly segregated from the treated strands, there will be a bleeding or blending of the applied bleach or dye from areas which are substantially wholly bleached to areas which are substantially wholly unbleached or undyed. This, of course, presents a more natural appearance than if the material were not to bleed which would give a sharp demarkation between the treated hair and the untreated hair.

If it is desired to reduce the amount of bleeding, a simple technique is to increase the viscosity of the hair treating material. As will be evident to stylists skilled in the art, this can be accomplished in a variety of ways. First, when using a dye which has a peroxide mixed therewith, instead of mixing a conventional peroxide, a cream peroxide may be used to increase the viscosity of the dye thereby minimizing the amount of bleeding that will occur. In the alternative, white henna, cornstarch or other thickener may be added to the hair treating material to thereby increase its viscosity and decrease the amount of bleeding that occurs.

Although the invention has been described in its preferred forms with a certain degree of particularity, it is understood that the present disclosure is only by way of example and that numerous changes in the details of construction and the combination and arrangement of parts may be resorted to without departing from the spirit and scope of the invention as hereinafter claimed.

I claim:

1. An applicator for distributing a hair treating material onto less than all of the hair of an individual, comprising a body having a chamber therein and including means for attaching the body to a material supply container in communication with the chamber; and a comb structure carried by the body for distributing the material, including a plurality of first teeth pairs having therebetween roots of a first depth and a plurality of second teeth pairs having therebetween roots of a second depth, different from the first depth, and conduit means commuicating with the chamber and opening through the roots between at least some of the first teeth pairs, there being no communication between the chamber and the space between the second teeth pairs.

2. The applicator of claim 1 wherein the first roots are shallow and are spaced closer to the free ends of the teeth than the second roots.

3. The applicator of claim 2 wherein the conduit means open through the shallow roots.

4. The applicator of claim 3 wherein the shallow roots alternate with the second roots.

5. The applicator of claim 3 wherein each shallow root is disposed between the second roots.

6. The applicator of claim 2 wherein the distance between the shallow roots and the second roots is uniform.

7. The applicator of claim 1 wherein the first roots are deep and are spaced further from the free ends of the teeth than the second roots.

8. The applicator of claim 7 wherein the conduit means open through the deep roots.

9. The applicator of claim 7 wherein the deep roots alternate with the second roots.

10. The applicator of claim 7 wherein each deep root is disposed between the second roots.

11. The applicator of claim 7 wherein the distance between the deep roots and the second roots is uniform.

12. The applicator of claim 1 wherein each tooth defines a tooth axis, all of the teeth axes being parallel.

13. The applicator of claim 12 wherein all of the teeth terminate, at the free ends thereof, in a common plane.

14. The applicator of claim 12 wherein the first roots terminate in a surface inclned to the axes at an acute angle.

15. The applicator of claim 12 wherein the attaching means defines an axis of the material supply container, the material supply container axis and the teeth axes defining an obtuse angle.

16. The applicator of claim 3 wherein all of the teeth terminate, at the free ends thereof, in a common plane.

17. The applicator of claim 7 wherein all of the teeth terminate, at the free ends thereof, in a common plane.

18. An applicator for distributing a hair treating material onto less than all of the hair of an individual, comprising a body having a chamber therein including means for attaching the body to a material supply container in communication with the chamber; and a comb structure carried by the body for distributing the material, including a plurality of first teeth pairs having roots of a first depth therebetween and a plurality of second teeth pairs having roots of a second depth, different from the first depth, therebetween, each tooth defining a tooth axis, all of the teeth axis being parallel, all of the teeth terminating, at the free ends thereof, in a common plane, the first roots terminating in a surface inclined to the axes at an acute angle, and conduit means communicating with the chamber and opening between at least some of the first teeth pairs, there being no communication between the chamber and the space between the second teeth pairs, the attaching means defining an axis of the material supply container, the material supply container axis and the teeth axes defining an obtuse angle, the first roots terminating in a surface inclined to the tooth axis at an acute angle, the surface and the material supply container axis extending generally parallel.

* * * * *